United States Patent [19]

Cooper

[11] 3,990,871

[45] Nov. 9, 1976

[54] DUST COLLECTING APPARATUS WITH GAS FLOW REGULATOR

[75] Inventor: Jacob Cooper, North Hollywood, Calif.

[73] Assignee: Joy Manufacturing Company, Pittsburgh, Pa.

[22] Filed: Jan. 18, 1974

[21] Appl. No.: 434,437

Related U.S. Application Data

[63] Continuation of Ser. No. 336,139, Feb. 26, 1973, abandoned.

[52] U.S. Cl. ..... 55/129; 55/419; 138/46; 251/205

[51] Int. Cl.[2] ..... B03C 3/00

[58] Field of Search ..... 55/128, 129, 133, 418, 55/419; 137/625.3, 601; 251/205; 138/39, 46

[56] References Cited

UNITED STATES PATENTS

| | | | |
|---|---|---|---|
| 2,665,770 | 1/1954 | Richardson | 55/129 |
| 2,988,980 | 6/1961 | Tschudin | 98/40 D |
| 3,426,507 | 2/1969 | Kossowski et al. | 55/129 |

FOREIGN PATENTS OR APPLICATIONS

| | | | |
|---|---|---|---|
| 551,418 | 5/1932 | Germany | 55/128 |
| 135,173 | 11/1929 | Switzerland | 251/205 |
| 922,730 | 4/1963 | United Kingdom | 55/128 |

*Primary Examiner*—Bernard Nozick

[57] ABSTRACT

A gas flow regulator disposed within a gas flow path and having integral baffling means thereon to deflect such a gas flow transversely of the direction of the gas flow in a manner to provide a uniform gas distribution where there is a change in cross-sectional areas of the gas flow path. Furthermore, the regulator of the present invention includes valve means thereon to further regulate the gas flow. The gas flow regulator is particularly applicable to dust collecting assemblies, such as electrostatic precipitators.

8 Claims, 7 Drawing Figures

DUST COLLECTING APPARATUS WITH GAS FLOW REGULATOR

This application is a Continuation of United States Patent Application Ser. No. 336,139, filed Feb. 26, 1973 now abandoned.

Gas flow such as into a precipitator must of necessity proceed from a duct or flue of limited cross-sectional area into a precipitator of much larger cross-sectional area in order to reduce the rate of flow through the precipitator in the interest of high precipitator efficiency by avoiding re-entrainment of precipitated particles by rapidly moving air currents impinging upon the precipitated matter.

Flat perforated plates, transverse to the gas flow, as commonly used in precipitators for gas flow control, yield results largely dependent upon the upstream flow geometry; i.e., they evenly distribute the downstream flow if the gas stream is generally perpendicular to the plane of the plate, otherwise, the perforated plate appears to bend the gas stream so that, upon leaving the plate, the angle of the stream to the desired flow path through the precipitator, is greater than the angle approaching the plate. With the flat plate distributors there is also the problem of the gas flow skidding along the perforated plate and causing a piling up of gas at one side or the other of the precipitator with consequent deleterious effect on the desired flow distribution within the precipitator.

The device of the present invention avoids skidding in a transverse direction by introducing transverse zig zags into the perforated plate, with necessary perforations located in the valley areas of the zig zag plate as viewed from the upstream side thereof. Skidding in the other transverse direction is prevented by the use of baffle plates extending upstream from the face of the zig zag plate and normal to the extent of the zig zags so that there is no possibility of horizontal skidding.

In order to provide the best possible control of the flow through the precipitator it has been found advisable to provide a flow equalizer comprising a perforated zig zag plate with valve plates fitted to the valleys of the zig zag plate in a manner to be slideable therealong to provide for individual adjustment of the size of the openings in different areas of the flow equalizer for further flow control.

It is to be noted that the perforations are in the valley areas of the zig zag plate as viewed from upstream. This location provides little or no support for dust which might be deposited by the dirty gas and keeps the plate of this invention much cleaner and reduces necessary rapping to a minimum.

The resilience of the zig zag plate due to its shape and perforations also helps to make rapping more effective. p Thus the advantages resident in the gas flow equalizer of this invention arise from omnidirectional gas flow control to produce substantially uniform flow through the whole cross sectional area of the precipitator.

These and other objects and advantages of this invention will become more easily understood upon consideration of the following description and drawings in which.

Figure 1:
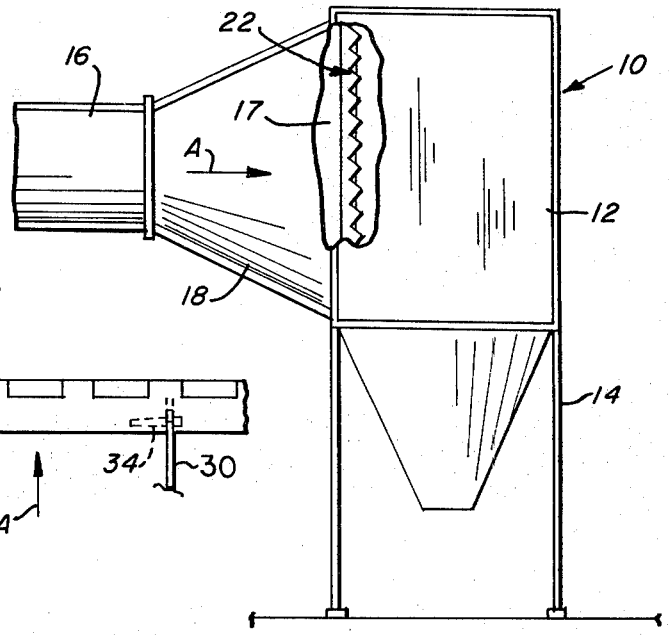
FIG. 1 is a schematic representation of a side elevational view of a precipitator incorporating a gas flow equalizer constructed according to the principles of this invention.
Figure 4:
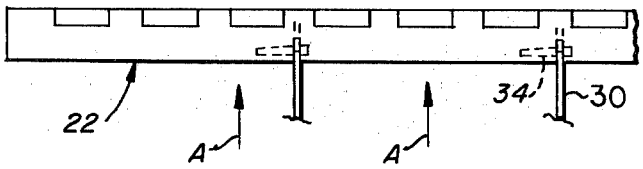
FIG. 4 is a schematic representation of a view taken substantially on line 4—4 of FIG. 3 looking in the direction indicated by the arrows.
Figure 5:
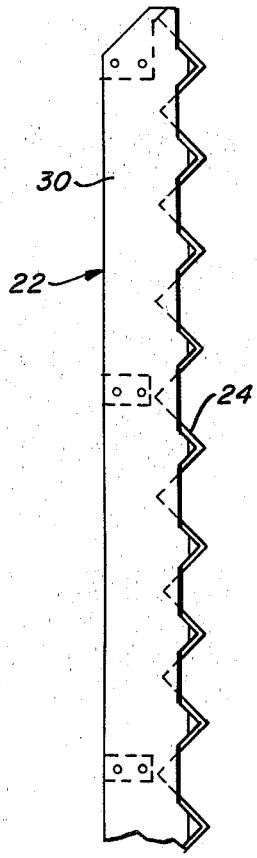
FIG. 5 is a fragmentary side elevational view of the gas flow equalizer constructed according to the principles of this invention.
Figure 2:
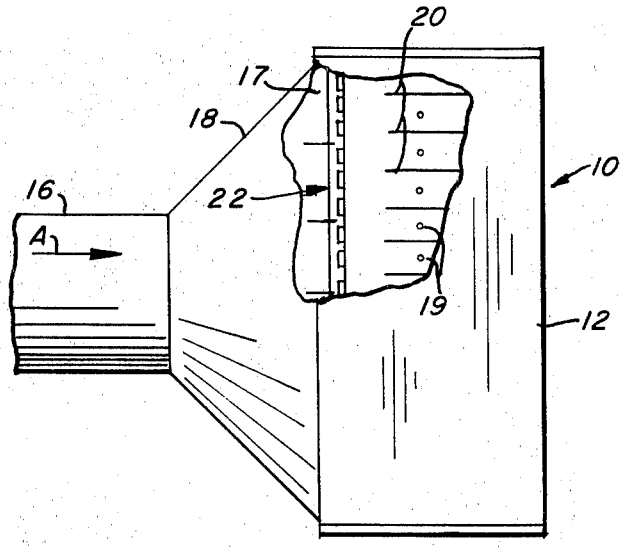
FIG. 2 is a schematic representation of a top plan view of the precipitator of FIG. 1.

In FIGS. 1 and 2 there is shown a schematic representation of an electrostatic precipitator generally indicated at 10 comprising an enclosed housing 12 mounted on legs 14 and provided with an inlet flue 16 communicating with a side opening 17 of housing 12 by way of any suitable duct work shown by way of example as a frusto pyramidal "camera" inlet 18 of a well known type wherein gases from the inlet flue 16 are distributed through the precipitator 10 to the outlet thereof (not shown) so that there will be a flow of gas to be treated by charging electrodes 19 and collector plates 20 of the precipitator. The plates 20 as shown are vertically extending, parallel to each other and equally spaced apart with charging electrodes therebetween in a manner well known in the field of electrostatic precipitation.

Figure 3:
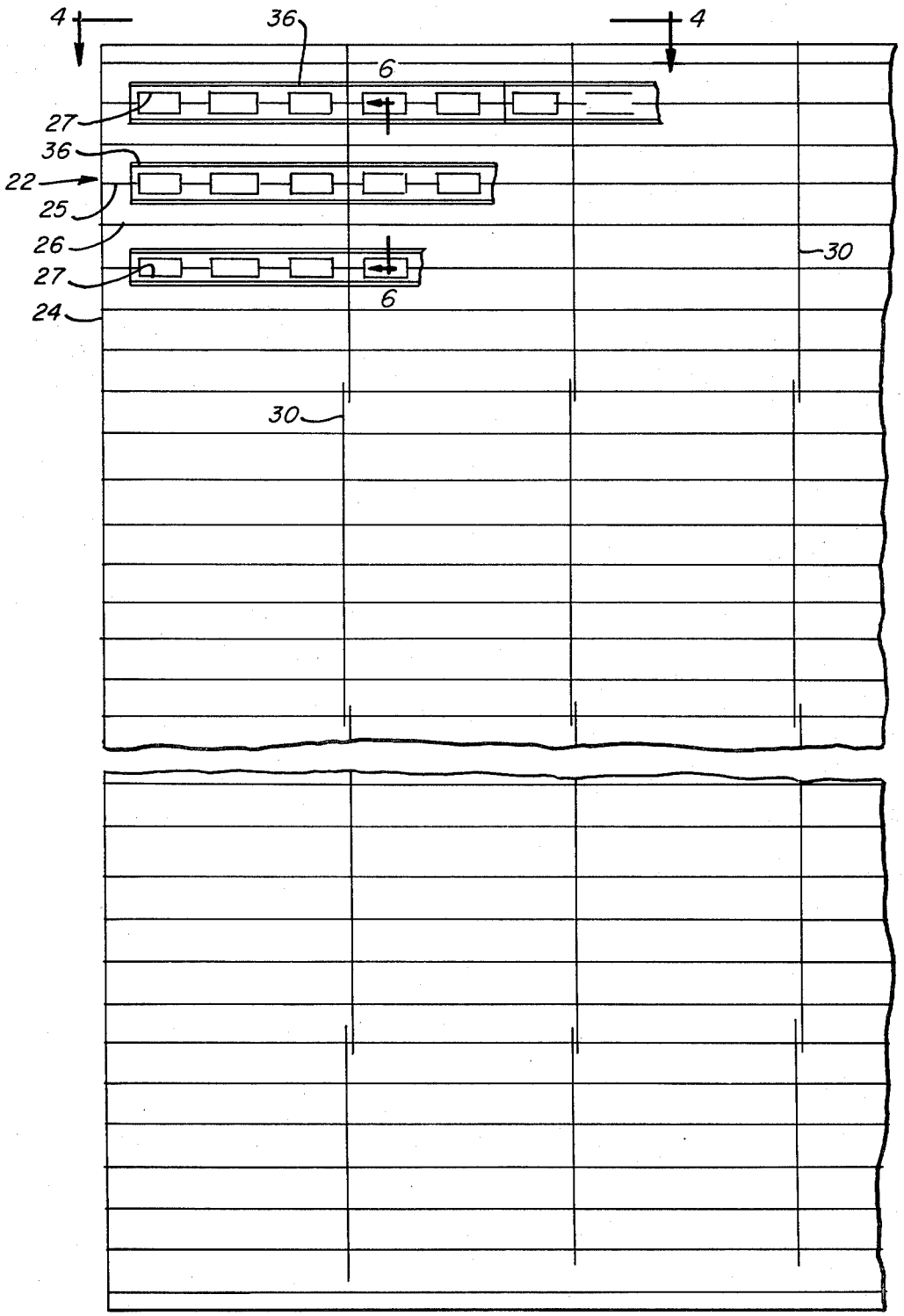
FIG. 3 is a fragmentary schematic representation of a front elevational view of a gas flow equalizer device constructed according to the principles of this invention.
Figure 7:
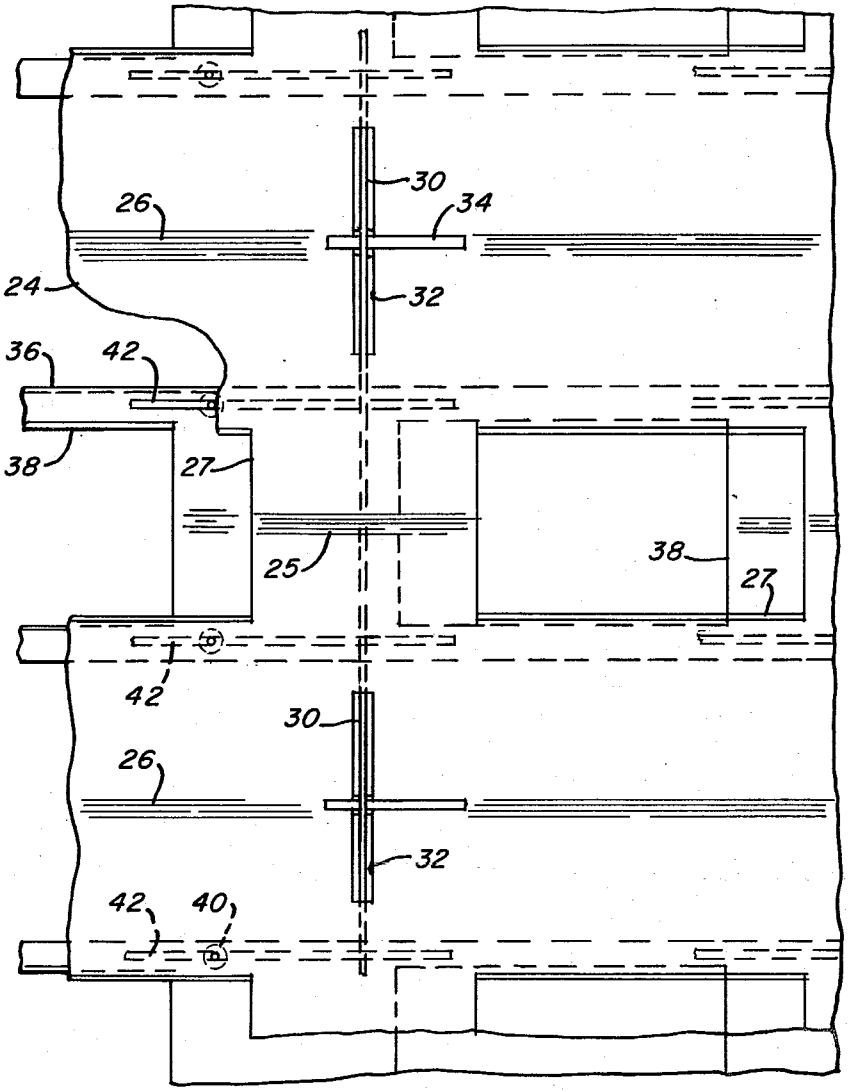
FIG. 7 is a fragmentary view taken substantially on line 7—7 of FIG. 6 looking in the direction indicated by the arrows.

In order to avoid having areas of greater and lesser velocity, between various pairs of the plate 20, a gas flow equalizer generally indicated at 22, constructed according to the principles of this invention, is shown installed in the precipitator 10 upstream from the plates 20 by a distance of 18 inches or more to provide for divergence of the jets of gas from the perforations and comingling of the jets into a substantially uniform flow across the entire cross-section of the precipitator. The flow equalizer 22 comprises a plurality of corrugated or zig zag plates 24 having corrugations such as alternate troughs 25 and ridges 26 extending horizontally across the side opening of the precipitator 10 with four or more of the plates 24 overlapping, fitted together and covering the whole side opening 17 of the precipitator 10. As hereinafter used the troughs 25 and the ridges 26 will be as considered from the upstream side as indicated by the gas flow arrows A of FIGS. 1, 2 and 4 through 6. As seen in FIGS. 3 and 7 each of the troughs 25 is provided with a plurality of equally spaced apart rectangular openings extending on both sides of the center line of the trough 25, respectively.

It is to be realized that in FIG. 3 only a few of the openings have been shown as typical openings which would be found in similar spacing and size all over each one of the plates 24 assembled to cover the side opening of the precipitator 10. Using the arrangement of plates just described, with the openings 27 therein, a significant improvement in the distribution of gas from the inlet flue 16 will be accomplished since the troughs and ridges of the plates 24 prevent transverse flow or skidding of the gas flow upwardly or downwardly as has been found to be common with flat perforated plates. Since the collector plates 20 are themselves vertical they have a marked tendency to prevent transverse skidding in a horizontal direction of the gas flow from the inlet 16.

It has been found however that there is a marked tendency of the gases to skid along the troughs 25 and in order to prevent such skidding the plates 24 are provided with vertically extending baffles 30 which extend outwardly in an upstream direction from the zig zag plates 24 to a distance perhaps three times the depth of the troughs 25. To provide proper spacing (approximately two feet in a typical installation) long narrow slots 32 are provided in each of the ridges 26 into which the baffles 30 are fitted and then fastened in place as by a wedge element 34 (see FIGS. 4 and 6) or other suitable means of rigid connection such as riveting or welding.

Figure 6:
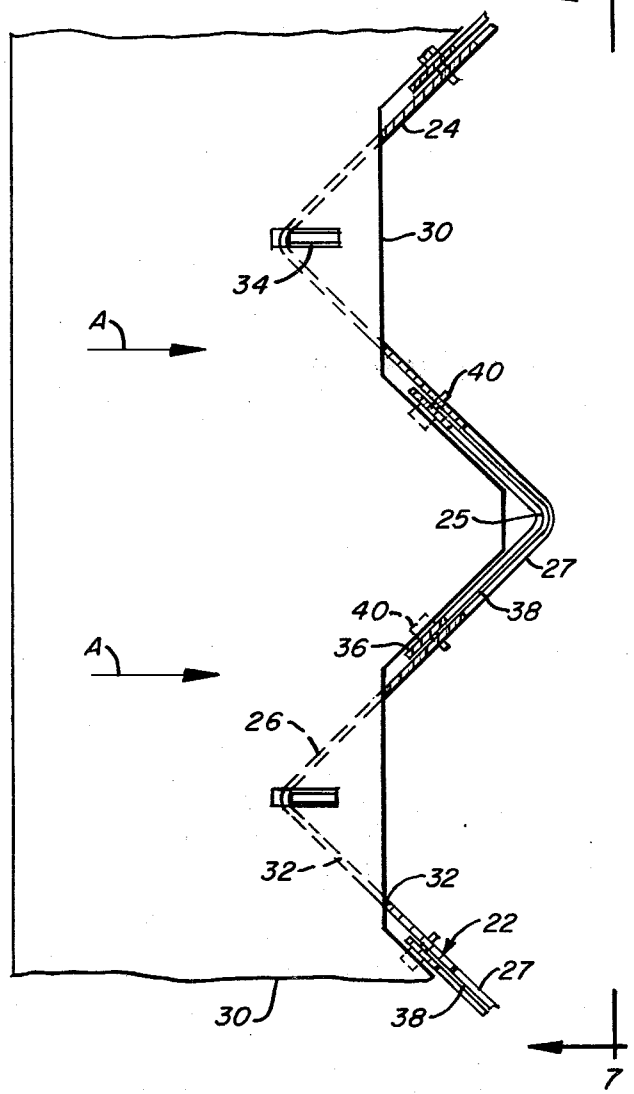
FIG. 6 is an enlarged side elevational view of a fragment of the gas flow equalizer of FIG. 5.

The wedge elements 34 will be seen to have forced the baffles 30 against the bottoms of the slots 32 but the baffles 30 are formed so that there is a space between the baffles 30 and the deepest portion of each trough 25 of the zig zag plates 24 to provide for installation of horizontally extending elongated valve plates 36 of V-shaped cross section best seen in FIGS. 3, 6 and 7 with one line of valve plates 36 being installed in each trough portion 25 of each zig zag plate 24. The valve plates 36 are provided with rectangular openings 38 centered on, and extending on both sides of the apex portion of the V-shape of the plates 36 to approximately match in size and location the openings 27 of the trough portions 25 at each location all over the plates 24. Threaded fasteners such as self-tapping screws 40 are inserted through slots 42 (FIG. 7) in the valve plates 36 and threadedly engaged with the zig zag plates 24 to provide for sliding the valve plates 36 horizontally back and forth to adjust the amount of gas flow opening to make possible the multi-directional flow control effected by the application of the principles of this invention as hereinafter described.

After having been assembled as above described the flow equalizer 22 is hung across the side opening 17 of the precipitator 10 and the valve plates 36 are adjusted for providing a uniform rate of flow throughout the whole precipitator. Such adjustment would be based on experience with a similar precipitator or precipitator model having the same or nearly the same relationship between the size of the inlet flue 16 and the opening 17 in the side of the precipitator 10, the same or nearly the same angle and rate of flow, temperature, dust loading and the like so that the first adjustment of the valve plates 36 could be approximately that required for uniform flow. It has been found advisable to simulate each inlet at ¼ scale to get a good idea of the required adjustment for use in the field.

After the above adjustment has been made the screws 40 are tightened, the precipitator inlet and camera connector are assembled with the precipitator and flow readings taken at various locations within the precipitator to determine the accuracy of the approximation. With such test results in hand a decision may be made as to whether flow is sufficiently uniform to obviate the necessity for entering the camera inlet and readjusting the openings to improve the test results. If such entering and readjustment are found to be advisable, repositioning and retesting is continued until uniform flow through all parts of the precipitator side opening 17 has been satisfactorily achieved.

It is to be noted that the effect of the flow equalizer 22 when properly adjusted is considered to be the provision of substantially uniform flow across the whole precipitator opening 17 with resulting high efficiency due to full utilization of all parts of the collection system and due to minimum re-entrainment of the collected particles.

It is further to be realized that the above description is that of a preferred embodiment of the principles of this invention but that other ways of applying these principles are envisioned and possible, particularly in the use of two or more of the flow equalizers spaced approximately a foot apart, parallel to each other across the stream flow with the troughs and ridges of one equalizer extending horizontally and the troughs and ridges of another equalizer extending vertically. Such variations in the use of the principles of this invention might well be made necessary where very abrupt changes of direction are present in the inlet duct work.

In the case of using two or more of the zig zag plates it might not be necessary to use any of the valve plates 36 or a set of valve plates 36 on one of the zig zag plates might be used for the complete adjustment of the flow rates although other zig zag plates were used for straightening the flow.

The baffles 30 often found to be necessary in using a single zig zag plate might be wholly or partially unnecessary with the use of more than one zig zag plate.

The principles of this invention are found to reside in the method of intercepting the turbulent flow in a precipitator inlet, removing transverse components of the flow, dissecting such flow into discrete separate gas streams through individual openings which results in straight through flow of the individual streams, reassembling the streams into a common flow pattern of uniform velocity throughout all parts of the precipitator.

It is to be further realized that the gas flow regulator as described hereinabove is equally applicable to utilizations other than with electrostatic precipitators; for example, such a regulator can be used in baghouse collecting systems and cyclone separators. Still further, inasmuch as the invention herein resides broadly in utilizing integral means to direct the flow in at least one transverse direction, the utilization of the valving arrangement in conjunction with the baffling means is considered to be an improvement over the basic concept. It is to be further understood that baffling means other than the corrugated section are contemplated.

A preferred embodiment of the principles of this invention having been hereinabove set forth it is respectfully requested that this invention be interpreted as broadly as possible and limited only by the scope of the claims appended hereto.

What is claimed is:

1. A dust collecting apparatus comprising: a dust collecting housing having an opening therein; gas conveying means for directing a flow of particulate laden gas into said opening; the cross-sectional area of the major extent of said conveying means being less than the cross-sectional area of said opening; a gas flow regulator extending across said opening for regulating the flow of gas directed thereinto; said regulator having a plurality of spaced perforations for passing such flow of gas therethrough; at least a major portion of said regulator being corrugated with alternate elongated ridge portions and trough portions, the apexes of said ridge portions being upstream from the apexes of said trough portions; each of said perforations being in one of said trough portions adjacent the apex thereof and extending on both sides of the apex thereof; and means for selectively varying the unobstructed area of at least some of said perforations.

2. A dust collecting assembly as specified in claim 1 wherein each of said perforations is substantially equally spaced between the apexes of said ridge portions which are adjacent thereto.

3. A dust collecting assembly as specified in claim 1 additionally comprising: planar baffling means on the upstream side of said flow regulator and extending transverse to said ridge and trough portions; said baffling means being positioned between selected adjacent perforations.

4. A dust collecting assembly as specified in claim 1 wherein said gas flow regulator is vertically positioned within said opening and said ridge and trough portions extend in a horizontal direction.

5. A dust collecting assembly as specified in claim 1 wherein said means for selectively varying comprises a plurality of valve means cooperable with said trough portions to vary the unobstructed area of said at least some of said perforations.

6. A dust collecting assembly as specified in claim 5 wherein said valve means comprises a plurality of elongated valve plates of V-shaped cross-section slidable adjacent a respective trough portion and having spaced apertures which approximately coincide with respective ones of said perforations at one relative position thereof; the area of said valve plates between adjacent aperatures being adapted to cover selected portions of said perforations to cause selective restriction of selected ones of said perforations.

7. The apparatus as specified in claim 1 wherein said dust collecting assembly is an electrostatic precipitator.

8. The apparatus as specified in claim 7 wherein said electrostatic precipitator contains plate type collecting electrodes and said collecting electrodes are spaced inwardly of said precipitator from said gas flow regulator by a distance greater than the spacing between said collecting electrodes.

* * * * *